United States Patent [19]

Hsu

[11] Patent Number: 4,726,206

[45] Date of Patent: Feb. 23, 1988

[54] ALARM LOCK WITH REPLACEABLE LOCK BODY

[76] Inventor: Sheau-Po Hsu, No. 8, Lane 232, Line-Sen Rd., Hu-Wei, Yunlin Hsien, Taiwan

[21] Appl. No.: 610,488

[22] Filed: May 15, 1984

[51] Int. Cl.[4] ..... E05G 1/04; E05B 17/00

[52] U.S. Cl. ..... 70/441; 109/38; 109/44; 109/51; 109/53 R; 109/53 T; 70/DIG. 49

[58] Field of Search ..... 70/441, 364 R, DIG. 49, 70/451, 370; 109/51, 52, 50, 44, 43, 38, 59 R, 59 T, 64, 80

[56] References Cited

U.S. PATENT DOCUMENTS

| | | | |
|---|---|---|---|
| 402,590 | 5/1889 | Hall | 109/59 |
| 793,132 | 6/1905 | Hibbard | 109/59 |
| 1,919,647 | 7/1933 | Belknap | 109/59 |
| 2,011,944 | 8/1935 | Lodispoto | 70/DIG. 49 |
| 2,669,198 | 2/1954 | Campbell | 109/59 |
| 3,143,983 | 8/1964 | Maynard | 109/64 |
| 3,316,742 | 5/1967 | Wellekens | 70/451 |
| 3,415,086 | 12/1968 | Trainor | 70/370 |
| 4,029,919 | 6/1977 | Lumme | 70/DIG. 49 |
| 4,031,720 | 6/1977 | Avaiusini | 70/451 |
| 4,078,405 | 3/1978 | Steinbach | 70/DIG. 49 |
| 4,205,542 | 6/1980 | Renda | 70/DIG. 49 |
| 4,233,913 | 11/1980 | Herrmann | 109/53 T |
| 4,262,506 | 4/1981 | Tobel | 70/DIG. 49 |
| 4,284,014 | 8/1981 | Kuhn | 109/64 |
| 4,328,691 | 5/1982 | Scherbing | 70/DIG. 49 |
| 4,328,692 | 5/1982 | Dice et al. | 70/DIG. 49 |

FOREIGN PATENT DOCUMENTS

| | | | |
|---|---|---|---|
| 910068 | 9/1972 | Canada | 70/DIG. 49 |
| 0090675 | 10/1983 | European Pat. Off. | 109/59 T |
| 2436778 | 3/1975 | Fed. Rep. of Germany | 70/DIG. 49 |
| 2704478 | 8/1978 | Fed. Rep. of Germany | 70/DIG. 49 |
| 2141481 | 12/1984 | United Kingdom | 109/59 T |

*Primary Examiner*—Alexander Grosz
*Assistant Examiner*—Vinh Luong

[57] ABSTRACT

A lock comprising a hollow cylindrical seat, a cylindrical lock body for insertion into the seat and having a cavity in its exterior surface to accommodate a sphere therein, a screw hood for screwing onto the lock body, the hood having a plurality of cavities on its interior surface to accommodate the sphere, and a cylindrical lock barrel for insertion into the lock body and having a conical recession for accommodating the sphere to permit removal of the lock barrel and for pushing the sphere into the cavity in the screw hood to prevent removal of the lock barrel from the lock body.

6 Claims, 11 Drawing Figures

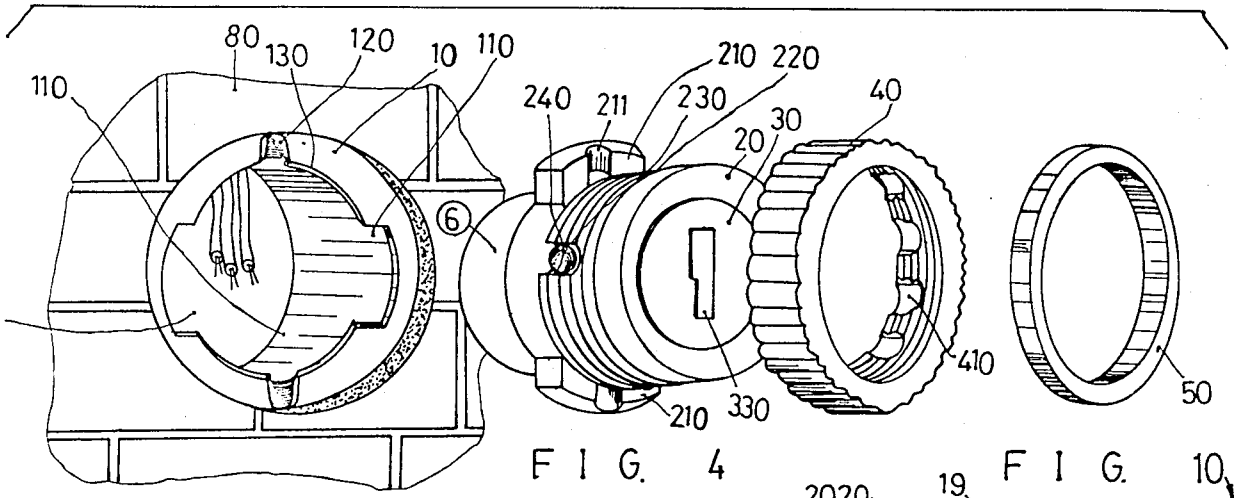
FIG. 4
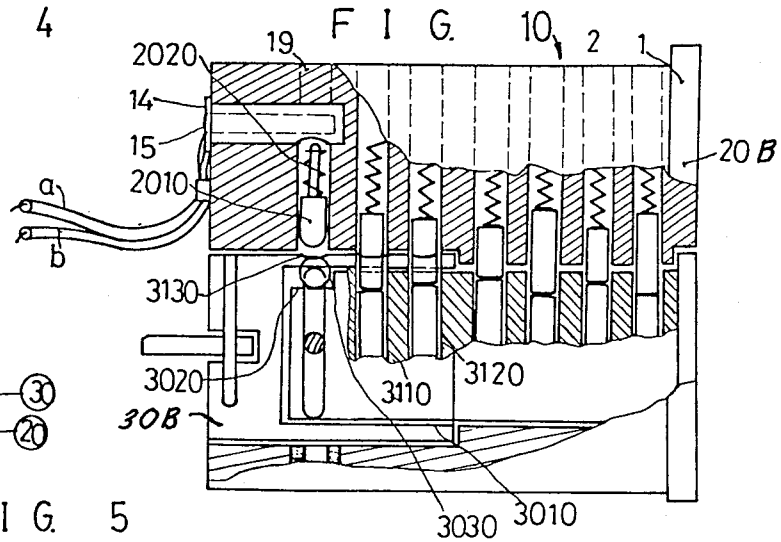
FIG. 5
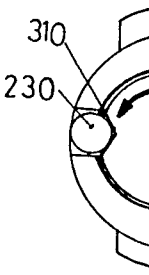
FIG. 11
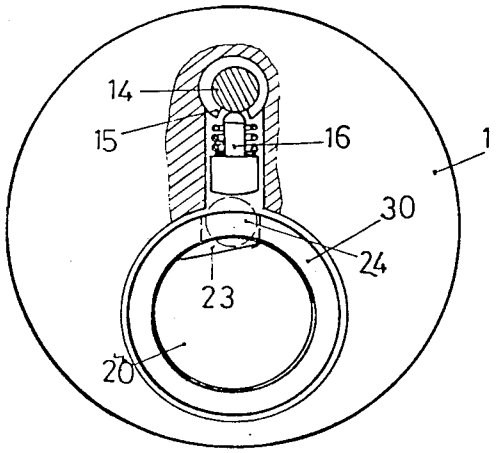

ALARM LOCK WITH REPLACEABLE LOCK BODY

BACKGROUND OF THE INVENTION

This invention relates to a kind of lock, particularly to a lock with a seat, for its lock body, to be fixed to a particular position on a wall and which is not removeable, a lock can be removed from the seat for replacement of lock body by rotating its lock barrel with a key and an alarm circuit which is controlled by the lock barrel.

At the present time, in general, there are three different kinds of lock being used on electric controlled doors of ordinary buildings: (1) wireless remote control (2) key board control with locked key board cover and (3) lock which is attached to the building with screws for direct control of the door. For wireless remote control lock, the burglar may use the method of adjusting the frequency to try to open the door and thus, the burglar-proof effect is very poor. For keyboard with locked cover, the cover can be opened easily with a knife or screw driver and thus, its burglar-proof effect is also very poor. For door directly controlled with a lock which uses a lock fixed to a block and then the block is fixed to the door by means of screws or bolts, a burglar will find no difficulty to remove the screws or bolts and then get the circuit closed for opening the door, and thus its burglar-proof effect is not satisfactory.

Furthermore, the conventional lock which controls opening and closing of electrical door directly has a defect: it gives no alarm while the lock is opened by a burglar.

In addition, no conventional lock has removeable lock body and replacement of lock due to rusting or change of owner is impossible. Replacement of lock requires breacking the wall if its fixing seat is fixed within a wall. Moreover, change and repair of lock are very inconvenient.

SUMMARY OF THE INVENTION

Therefore, it is a principal object of the present invention to provide a lock with replaceable lock body which has a special mechanism for fixing its lock body which can be removed by rotating its lock barrel with a key for replacement of lock body while no other person may be able to remove it for a higher degree of safety.

A further object of the present invention is to provide an alarm by means of a ball pushed by a recession margin of the cylindrical portion of the lock barrel for preventing the lock body from further rotation and activating alarm circuit while its lock barrel is rotated by external force.

A more complete understanding of these and other features and advantages of the present invention will become apparent from a careful consideration of the following detailed description of certain embodiments illustrated in tne accompanying drawings.

BRIEF DESCRIPTION OF THE DRAWINGS

FIG. 4 is an exploded view of another embodiment of the present invention.

FIG. 5 is a transverse cross-sectional view for the application of the embodiment as illustrated in FIG. 4.

FIG. 10 is a partial exploded view of the lock body and lock barrel of another embodiment of the present invention.

FIG. 11 is a longitudinal cross-sectional view of the embodiment as illustrated in FIG. 10 in an opended condition.

DESCRIPTION OF THE PREFERRED EMBODIMENT

Figure 1:
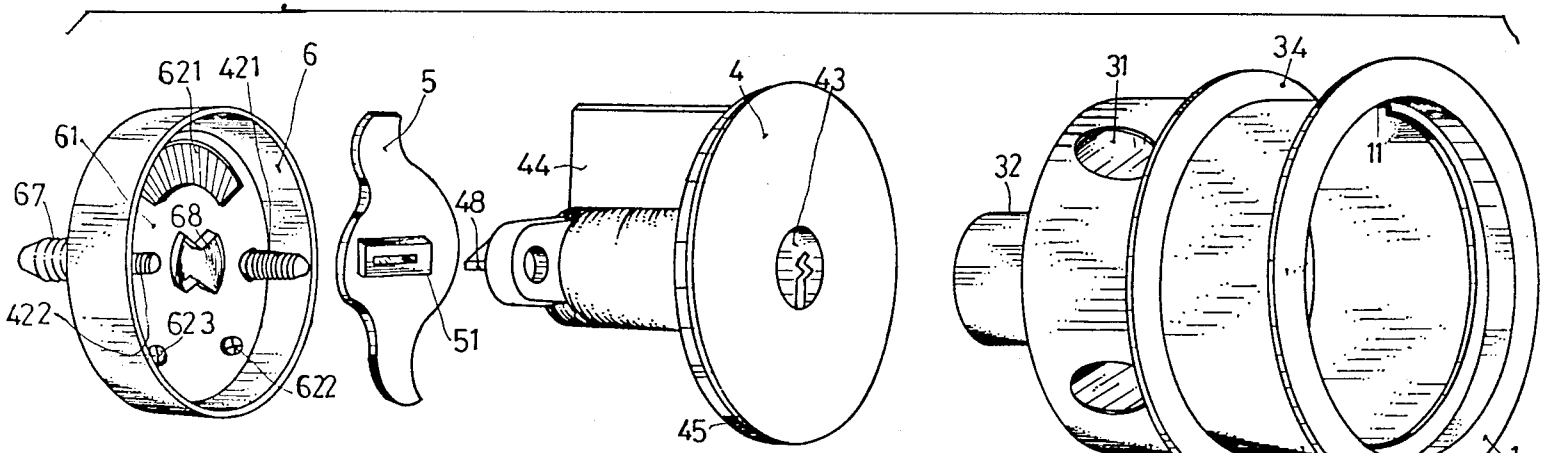
FIG. 1 is an exploded view of an embodiment of the present invention.

As shown in FIG. 1, the preferred embodiment of the present invention is composed of a seat 3, a lock body 4 and a switch assembly 6. The seat 3 is of a bowl-like structure with a plurality of holes 31 on it for installation of guide tube 7 to lead wires into the seat 3. At the bottom of the seat 3, there is a screwed hood 32 with threaded inner wall. The mouth of the seat 3 is extended outwards to form a flange 1. The lock body 4 is held within the seat 3. There is a lock barrel 43 which is rotatable by a key within the lock body 4. A linking plate 48 is extended backwards from the rear end of the lock barrel 43. A switch assembly 6 is installed behind the lock body 4. The said switch assembly is composed of conductors 621 and 622, insulator 623 and fixing screws 421 and 422 on a disc structure 61. On the disc structure 61, there is a screw post 67, which has a stop hole 68, which at its side forms a shape of reverse triangle with a tip towards its interior. The stop hole 68 allows the insertion of linking plate 48 from the end of the lock barrel 43. The linking plate 48, prior to its insertion into the stop hole 68 of the screw post 67, is fixed with the conductive plate 5 which has a hole 51 corresponding to the linking plate 48.

Figure 2:
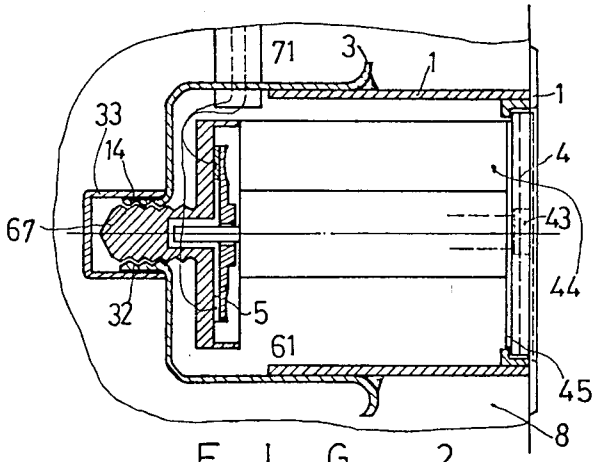
FIG. 2 is a cross-sectional view of the embodiment as shown in the FIG. 1.
Figure 3:
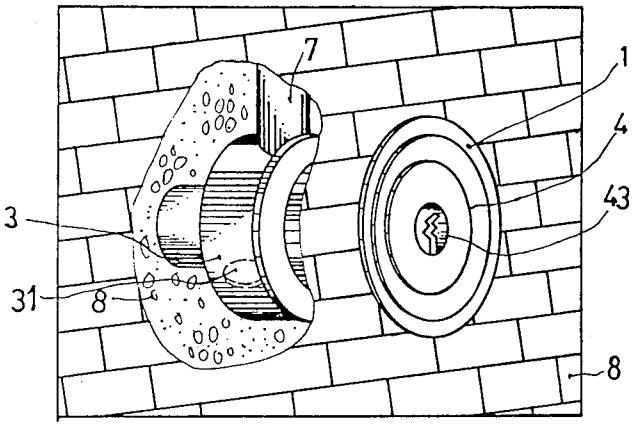
FIG. 3 shows the application of the embodiment as shown in FIG. 1.

With reference to the FIG. 1, FIG. 2 and FIG. 3 after the preferred embodiment of the present invention is installed within a wall, and while the lock barrel 43 is rotated with a key, the conductive plate 5 rotates. Once both ends of the conductive plate 5 touch the conductors 622 and 621 respectively, the circuit is closed. A further rotation of the lock barrel will disengage the conductive plate 5 from the conductor 621, and the linking plate 48 from the end of the lock barrel 43 will reach the inner wall of the stop hole 68 on the screw post 67. If the lock barrel 43 is rotated further the lock body 4 together with the lock barrel 43 and the switch assembly 6 can be removed for replacement or maintenance of lock body.

The above preferred embodiment can have some variations by changing the screw post 67 on the switch assembly 6 and the screwed hood 32 of the seat 3.

As shown in FIG. 4, another embodiment of the present invention comprises a lock body 20, a lock barrel 30 in the lock body 20, a fixing seat 10 which holds the lock body 20 and a screw hood 40. The seat 10 is in a cylindrical form with a cylindrical part which can be fixed within a wall 80. The stop plate 130 at the mouth of the fixing cavity 100 of the fixing seat 10 is in a form of outward recessive wedge 110 and there are recessive stop recessions 120 on the surface of the stop plate 130. Around the circumference of the lock body 20 there are two ears 210 corresponding to two said wedges 110. There is a fixing recession 211 on the surface of each ear 210. The section of the lock body 20 above the ear 210 is a threaded section 220, on it is a small cavity 240 for holding a ball 230, which is installed prior to the forming of the lock body 20 and thus it is not removeable. A lock barrel 30 is placed within the lock body 20. A screwed hood 40 is tightened to the lock body 20. The inner wall of the screwed hood 40 is threaded and there is a plurality of recessions 410 on it. There are some male threads on the surface of the screwed hood 40 to enhance a tight fit between the screwed hood 40 and wall 80. An application of the above embodiment is showned in FIG. 4 and FIG. 5. The rear section of the lock body 20 is inserted into the fixing seat 10, the threaded section 220 is fixed with the screwed hood; the ball 230 in the lock body 20 goes into the recession 410 of the inner wall of the screwed hood 40. A rubber ring 50 binds the front end of the lock body 20 so that the embodiment has a pleasing and consistant appearance after its installation. What we have to emphasized here is the existence of a conical recession 310 in the surface of the lock barrel 30, which cause the ball 230 to fall to the level of the circumference of the lock body 20 when the conical recession 310 is aligned with the ball cavity 240 on the surface of the lock body 20. At this moment, the screwed hood 40 can be tightened to the lock body 20. A turning of the lock barrel 30 pushes the ball 230 and allows the fixing of the screwed hood 40. Such a structure eliminates the use of screws and the replacement of lock body 20 is very easy and convenient.

Figure 6:
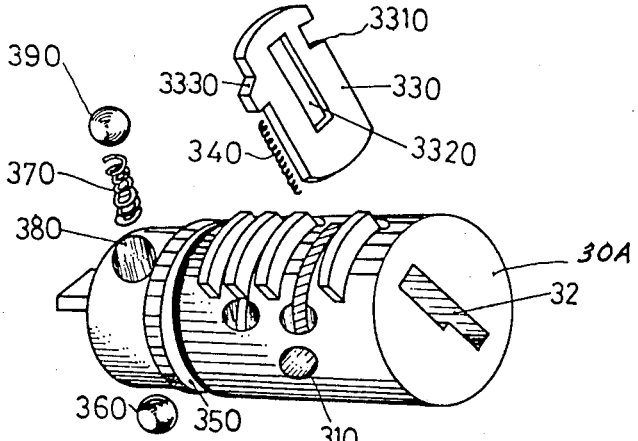
FIG. 6 is an exploded view of the lock barrel of the embodiment as illustrated in the FIG. 4.
Figure 8:
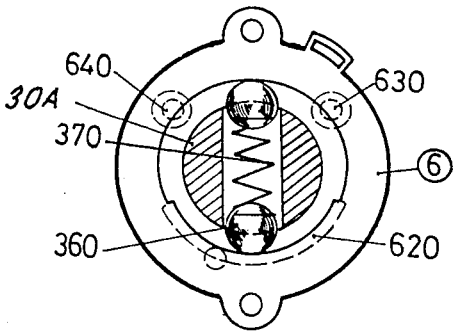
FIG. 8 is a transverse cross-sectional view of the conductor section of the embodiment as shown in the FIG. 7.
Figure 7:
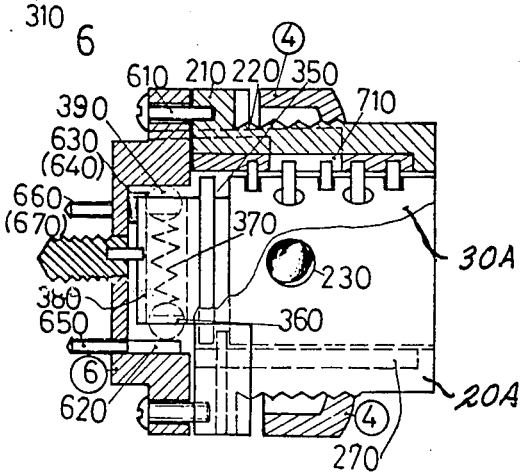
FIG. 7 is a longitudinal cross-sectional view of the lock barrel as shown in the FIG. 6.

With reference to FIGS. 6 and 7, the above embodiment has a power distribution panel 60 at the rear end of the lock body 20. On the inner wall of the distribution panel 60 there are conductors 620, 630 and 640 with leading terminals 650, 660 and 670 for wiring with the driving means of an electrical door. The lock barrel 30 has a transverse hole 380 wherein a spring 370 is loaded. The ends of the spring 370 are connected with conductive balls 360 and 390 respectively, wherein the conductive ball 360 keeps contact with the conductor 620 while the other conductive ball 390 keeps contact or non-contact with either the conductor 630 or 640. Therefore, the rotating of the lock barrel 30 can change the contact condition of the conductive ball 360 with the conductor 630 or 640 for the electrical door to perform different functions (as shown in FIG. 8).

Figure 9:
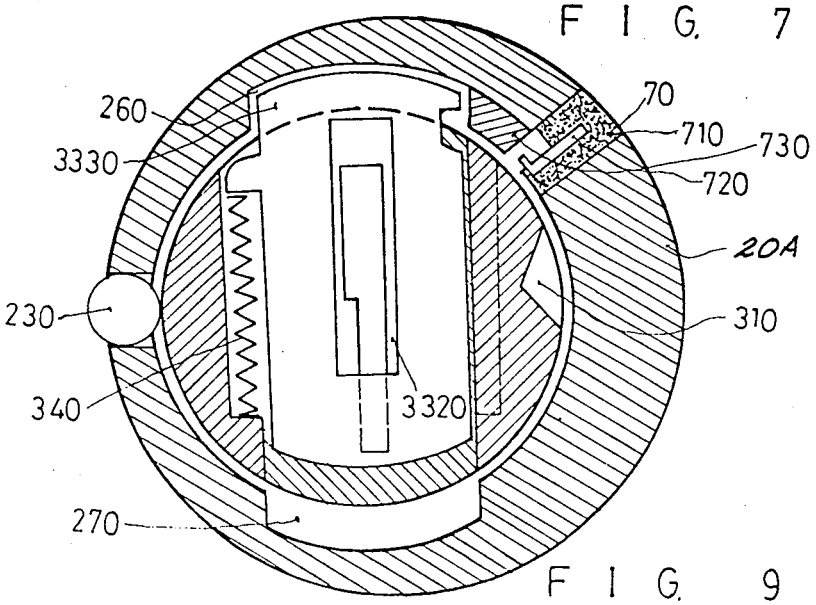
FIG. 9 is a transverse cross-sectional view of the lock barrel and lock body as illustrated in the FIG. 7.

With reference to FIGS. 6, 7 and 9, another embodiment of the lock body 20A and lock barrel 30A of the present invention is shown. A plurality of lock plates 330 is designed on a side of the lock barrel 30A. Each lock plate 330 has an extending wing 3330 on one side and a recession 3310 on the other side. It has also a key hole 3320. The lock plates extend beyond the surface of the lock barrel by the force of the spring 340. If a plate-like key margin inserted from the key hole of the top surface of the lock barrel matches with the lock plate 330, the lock plate will not extend beyond the circumference of the lock barrel 30A, and thus the lock barrel is rotatable. The inner wall of the lock body 20A has a plurality of recessions 260, 270 against the lock plates 330. Cavity 270 in Recession 260 is filled with insulation material 710 for fixing a conductive plate 720 in connection with a terminal 730 of the lock body 20A, which is then led to an alarm device. Thus, whenever there is an insertion of a key which does not match the key hole 3320 of the lock plates 330, some lock plates 330 will extend beyond the lock barrel 30A and rotation of the lock barrel will cause the lock plates 330 to contact the conductive plate 720 and the alarm device circuit is closed and gives an alarm.

FIG. 10, shows a lock barrel for the present invention. If the locking post is used for locking the lock barrel 30B with the lock body 20B, a sleeve 3010 is installed around the lock barrel 30B. The sleeve 3010 has holes 3110, 3120 and 3130 in consistence with the locking post hole on the lock body 20B. The lock barrel 30B has a slope recession 3020 in which a ball 3030 is held. The ball 3030 can expose toward a hole 3130 on the sleeve 3010. There is a pushing post 2010 against the hole 3130 on the lock body 20 which, by means of a spring 2020, hold itself at the lower dead corner. While the pushing post 2010 rises upwards, it contacts with a terminal of the alarm circuit, activates the alarm circuit which then gives an alarm. Therefore, if the lock barrel is rotating once the locking post is moved by any object, since the lock barrel 30B does not rotate the sleeve 3010 simultaneously, the ball 3030 will rise and push the pushing post 3010 upwards which will then motivate the alarm circuit to give an alarm.

I claim:

1. A lock comprising:

a hollow cylindrical seat adapted to extend through a hole and comprising a stop plate at one end thereof, the stop plate having provided therein a pair of opposing outward recessive wedge and a pair of opposing stop recessions;

a cylindrical lock body having a distal end and a proximal end and being adapted for insertion into the seat, the lock body having a longitudinally extending through bore, a pair of opposing ears being disposed on the exterior surface and near the distal end of the lock body, each ear having thereon a fixing recession for engaging the stop recessions in the seat, the exterior surface of the proximal end of the lock body being threaded, a cavity being provided on the exterior surface of the lock body to accommodate therein a ball;

a screw hood adapted for screwing onto the proximal end of the lock body, the screw hood having a plurality of cavities on the interior surface thereof to accommodate the ball; and a cylindrical lock barrel for insertion into the lock body, the lock barrel having conical recession for accommodating the ball to permit removal of the lock barrel and for pushing the ball into the cavity in the screw hood to thereby prevent removal of the lock barrel from the lock body.

2. The lock of claim 1 wherein the distal end of the lock body is connected to alarm means.

3. The lock of claim 1 wherein the distal end of the lock barrel is connected to alarm means.

4. The lock of claim 1 wherein the lock barrel is provided with a plurality of lock plates each inserted into a transversely extending bore in the lock barrel, the lock plates being biased to extend out of the bore, the interior surface of the lock body being provided with depressions into which the lock plates can extend to prevent rotation of the lock barrel.

5. The lock of claim 2 wherein the lock barrel is provided with a plurality of lock plates each inserted into a transversely extending bore in the lock barrel, the lock plates being biased to extend out of the bore, the interior surface of the lock body being provided with depressions into which the lock plates can extend to prevent rotation of the lock barrel.

6. The lock of claim 3 wherein the lock barrel is provided with a plurality of lock plates each inserted into a transversely extending bore in the lock barrel, the lock plates being biased to extend out of the bore, the interior surface of the lock body being provided with depressions into which the lock plates can extend to prevent rotation of the lock barrel.

* * * * *